United States Patent [19]

Searle

[11] Patent Number: 4,969,789

[45] Date of Patent: Nov. 13, 1990

[54] MACHINE FOR HANDLING MODULAR BUILDING COMPONENTS

[76] Inventor: Gregory P. Searle, 13209 Vivian Dr., Burnsville, Minn. 55337

[21] Appl. No.: 285,209

[22] Filed: Dec. 16, 1988

[51] Int. Cl.[5] ..... E04G 21/16

[52] U.S. Cl. ..... 414/10; 212/238; 212/160; 212/197; 294/81.61; 294/81.56; 414/719; 414/569

[58] Field of Search ..... 212/195, 232, 235, 238, 212/160, 196, 197; 414/569, 10, 719; 294/118, 107, 105, 81.61, 81.56

[56] References Cited

U.S. PATENT DOCUMENTS

| | | | |
|---|---|---|---|
| 119,120 | 9/1871 | Carothers | 294/105 |
| 1,573,263 | 2/1926 | Madden . | |
| 2,254,083 | 8/1941 | Nickles et al. . | |
| 2,297,291 | 9/1942 | Danielson | 294/118 |
| 2,978,115 | 4/1961 | Prestel | 212/197 |
| 3,008,753 | 11/1961 | Tazioli | 294/118 |
| 3,253,716 | 5/1966 | Stratton . | |
| 3,298,539 | 1/1967 | Sundstrom | 212/238 X |
| 3,313,107 | 4/1967 | Urish | 212/238 X |
| 3,874,532 | 4/1975 | Metailler | 414/569 X |
| 4,005,894 | 2/1977 | Tucek | 294/106 X |
| 4,326,571 | 4/1982 | Crawford | 212/238 X |
| 4,508,014 | 4/1985 | Shoff . | |
| 4,530,536 | 7/1985 | Williams | 294/118 |
| 4,643,320 | 2/1987 | Larsen . | |
| 4,646,875 | 3/1987 | Sholl . | |
| 4,679,336 | 7/1987 | Brocklebank et al. | 212/197 X |

FOREIGN PATENT DOCUMENTS

| | | | |
|---|---|---|---|
| 1684391 | 10/1969 | Fed. Rep. of Germany | 414/10 |

*Primary Examiner*—Frank E. Werner
*Assistant Examiner*—James T. Eller, Jr.
*Attorney, Agent, or Firm*—Merchant, Gould, Smith Edell, Welter & Schmidt

[57] ABSTRACT

An apparatus for handling and positioning building components of the type which are used in retaining walls or the like includes a vehicular support having an articulatable boom extending therefrom, and a gripper assembly at the end of the boom. The vehicle and boom are operatable through a remote control assembly by a worker who may be standing near the structure which is being constructed. Several species of gripping assemblies are included for attachment to the boom.

15 Claims, 7 Drawing Sheets

FIG.3B
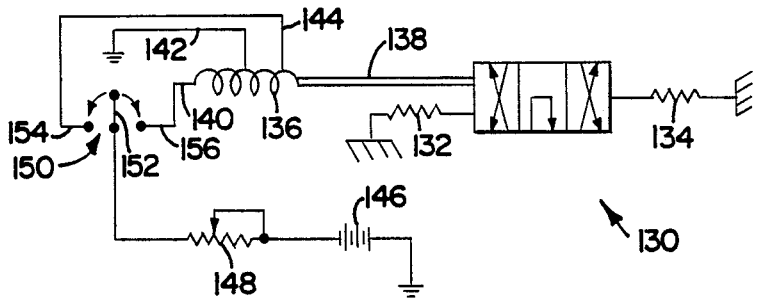
FIG. 4
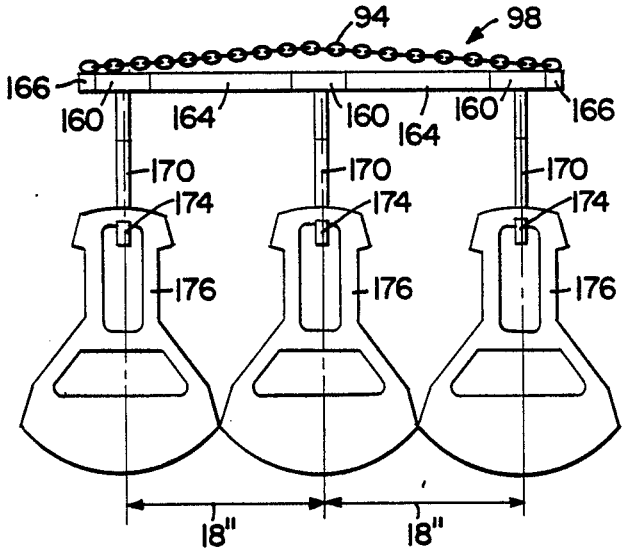
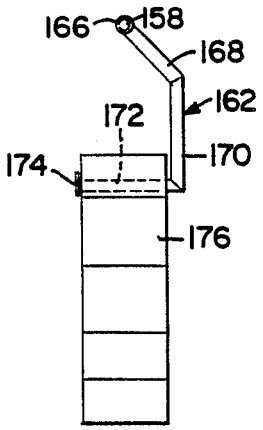
FIG. 5

MACHINE FOR HANDLING MODULAR BUILDING COMPONENTS

BACKGROUND OF THE INVENTION

1. Field of the Invention

This invention relates to an apparatus for handling modular building components of the type which are used in retaining walls or the like. More specifically, the invention relates to an apparatus which may conveniently be located at a work site and is adapted to grip a plurality of webbed blocks at one time so that the blocks may be transported from a storage position to their desired position onto the wall.

2. Description of the Prior Art

Concrete module blocks are commercially available in a wide range of sizes, shapes and textures for different uses in the construction industry. These nodules generally have one or more textured faces which are aesthetically pleasing, and are constructed so as to be easily stackable with respect to each other. The unique design of such modules allow them to effectively interlock with units above, below and on each side, resulting in an impressive structure with a high degree of strength and durability. An example of such modules is those which are manufactured by KeyStone TM Retaining Wall Systems of Edina, Minn.

Although these modular blocks are already noted for their ease of assembly, a great deal of manual labor is presently required to move each individual component from a storage position to its desired position on the structure that is being assembled. In addition, due to the irregular shape of the modules, the modules are not easily lifted and positioned by any mechanical devices heretofore known.

Clearly, there has existed a long and unfilled need in the prior art for an apparatus which is capable of lifting and positioning a number of concrete modules onto a structure that is being constructed.

SUMMARY OF THE INVENTION

Accordingly, it is an object of the invention to provide an apparatus which is capable of lifting and positioning a concrete modular building component onto a structure that is being built efficiently and with a minimum of manual labor.

In order to achieve the above object, the present invention provides an apparatus for handling building components of the type which are used in retaining walls or the like, comprising a vehicular support for positioning the apparatus at a desired location; a turret mounted for rotation with respect to the vehicular support; an adjustable boom having a first end mounted to the turret and a second end; a gripping assembly for gripping at least one building component; structure mounted to the boom proximate the second end for suspending the gripper assembly; and structure for controlling at least the turret and the boom, whereby a building component may be gripped and transported to a desired position.

According to one embodiment of the invention, the gripping assembly includes a first arm member having an upper section and a lower section; a second arm member having an upper section and a lower section; a pivot connecting the first arm member to the second arm member at points intermediate the upper and lower sections, respectively; a first gripper section connected to the first arm member lower section; a second gripper section connected to the second arm member lower section; and a flexible element for connecting the first arm member upper section to the suspending structure, whereby the gripper sections will be forced closed by a scissor-type action when the apparatus is used to grip a building component.

According to a second embodiment of the invention, the gripper assembly includes a support member; a first arm pivotally mounted to the support member at a first end and having a second end; a second arm pivotally mounted to the support at a first end and having a second end; a first gripper arm having a first end pivotally connected to the second end of the first arm; a second gripper arm having a first end pivotally connected to the second end of the second arm; a first gripper portion connected to a second end of the first gripper arm; a second gripper portion connected to a second end of the second gripper arm; and a pivot connecting the first gripper arm with respect to the second gripper arm, whereby the gripper arms are caused to tighten on a component as it is lifted.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIGS. 3A and 3B are a schematic diagram depicting the hydraulic control circuit in the apparatus illustrated in FIG. 1;

FIG. 4 is a side elevational view of the gripping mechanism illustrated in the embodiment of FIG. 1;

FIG. 5 is an end elevational view of the gripper assembly illustrated in FIG. 4;

DETAILED DESCRIPTION OF THE PREFERRED EMBODIMENT(S)

Figure 1:
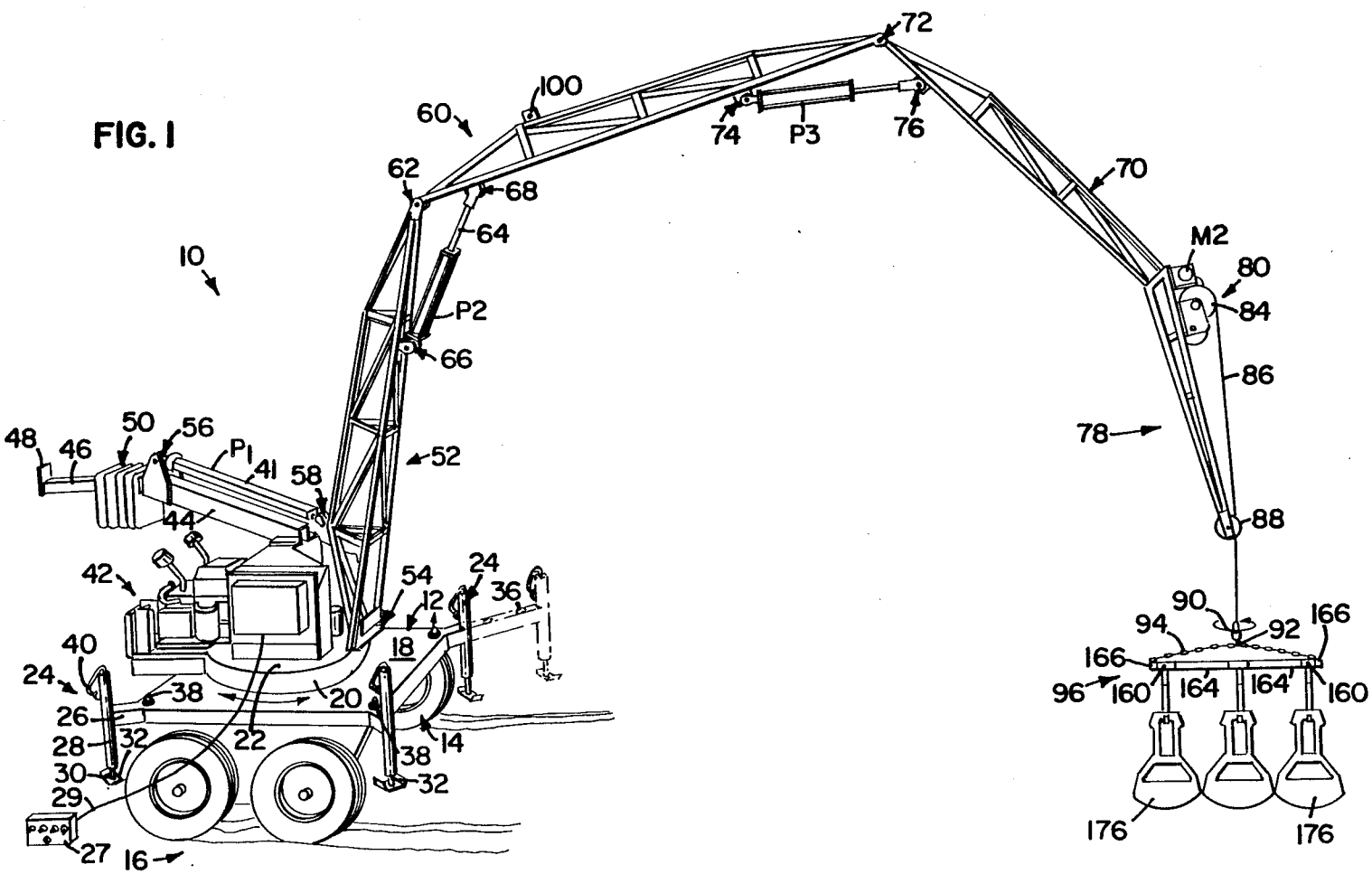
FIG. 1 is a perspective view of an apparatus constructed according to a first preferred embodiment of the invention.

Referring to the drawings, wherein corresponding structure is represented by like reference numerals throughout the views, and particularly referring to FIG. 1, an apparatus 10 constructed according to a first embodiment of the invention includes a vehicular support platform 12 which is supported by a pair of left wheels 14 and a corresponding pair of right wheels 16. Support platform 12 has an upper surface 18 on which a rotatable turret 20 is mounted. Rotatable turret 20 is supported for rotation with respect to support platform 12 by a conventional bearing structure, and includes a boom support platform 22 for purposes which will be below described.

Figure 2:
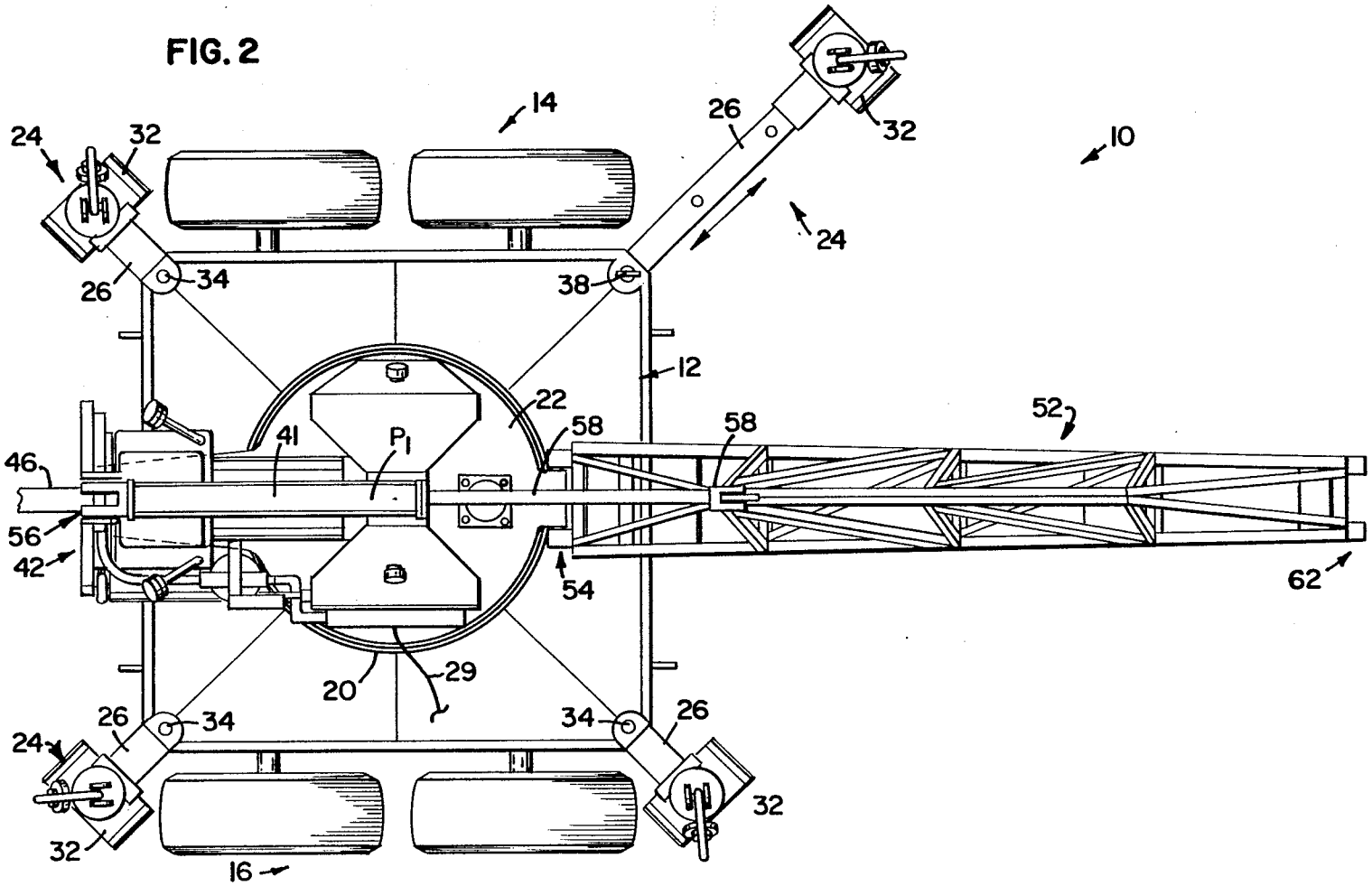
FIG. 2 is a fragmentary top plan view of the apparatus illustrated in FIG. 1.

In order to stabilize support platform 12 with respect to an underlying surface such as the surface of the earth at a work site, support platform 12 is provided with four stabilizer units 24, which are best viewed in FIGS. 1 and 2. As is shown in FIG. 2, each stabilizer unit 24 includes a support beam 26 which is telescopingly engageable with the body of support platform 12 and has a plurality of alignment holes 36 defined therein. A pinhole 34 is defined in each portion of support platform 12 which overlies a support beam 26. Pins 38 are provided for insertion through pinholes 34 and the selected alignment holes 36. In this way, the degree of extension of a particular stabilizer unit 24 may be fixed with respect to the support platform 12.

As best illustrated in FIG. 1, each stabilizer unit 24 further includes a cylindrical housing 28 which is vertically affixed to an end portion of support beam 26. A rod 30 having a support foot 32 is slidably received within each of the cylindrical housings 28. Each of the support feet 32 are adapted to engage the underlying surface in order to give stability to support platform 12. A crank 40 is provided on an upper portion of each of the cylindrical housings 28 in order to vertically adjust the position of rod 30 and foot 32 with respect to the corresponding housing 28. This adjustment is effected by a thread type arrangement which is readily known by those having ordinary skill in the art. For instance, each of the cranks 40 may be connected to a threaded rod which is threadedly engaged with a slidable sleeve attached to the corresponding rod 30 and support foot 32.

Referring now to the structure of rotatable turret 20, boom support platform 22 has an extension supporting an internal combustion engine 42, as may be seen in FIGS. 1 and 2. Also affixed to boom support platform 22 is a support bracket 44 which extends upwardly over internal combustion engine 42. A counterweight holder 46 is affixed so as to extend behind support bracket 44 and includes a retaining lip 48 for retaining a desired number of counterweight members 50, which may be manually added or removed from the counterweight holder 46.

Referring again to FIG. 1, apparatus 10 further includes a boom having a first boom section 52, which is pivotally jointed to boom support platform 22 by a first pivot joint 54. In order to control the position of first boom section 52 relative to boom support platform 22, a hydraulic piston-cylinder unit $P_1$ is provided with a first end joined to support bracket 44 via a pivotal connection point 56, and a second end joined to boom section 52 via a pivotal connection point 58.

A second boom section 60 is pivotally joined to first boom section 52 at a second pivot joint 62. A second piston cylinder unit $P_2$ having a first end pivotally connected to first boom section 52 via a pivotal connection point 66 and a second end pivotally connected to second boom section 60 via pivotal connection point 68 is provided for controlling the relative position between the first and second boom section 52, 60.

The boom member further includes a third boom section 70 which is pivotally connected to second boom section 60 via a third pivot joint 72. A third piston cylinder unit $P_3$ is pivotally joined to the second and third boom sections 60, 70 via pivotal connection points 74, 76, respectively. Third boom section 70 includes a cable feed support section 78 which has a winch assembly 80 mounted thereon, as is illustrated in FIG. 1. Winch assembly 80 includes a cable winding drum 84 having a cable 86 wound thereon, and a hydraulic motor $M_2$ for selectively rotating drum 84. An idler roll guide 88 is provided at a distal end of third boom section 70 for guiding cable 86. A swivel joint 90 is provided on an end portion of cable 86 and has a D-ring 92 or like coupling suspended therefrom for supporting a block gripping assembly 96 via a chain 94, as is shown in FIG. 1.

In the preferred embodiment, a remote control unit 27 is connected to support platform 12 via a cable 29. Remote control unit 27 enables an operator to control operation of apparatus 10 from a position near the structure being constructed, as will be described in detail below.

Figure 3A:
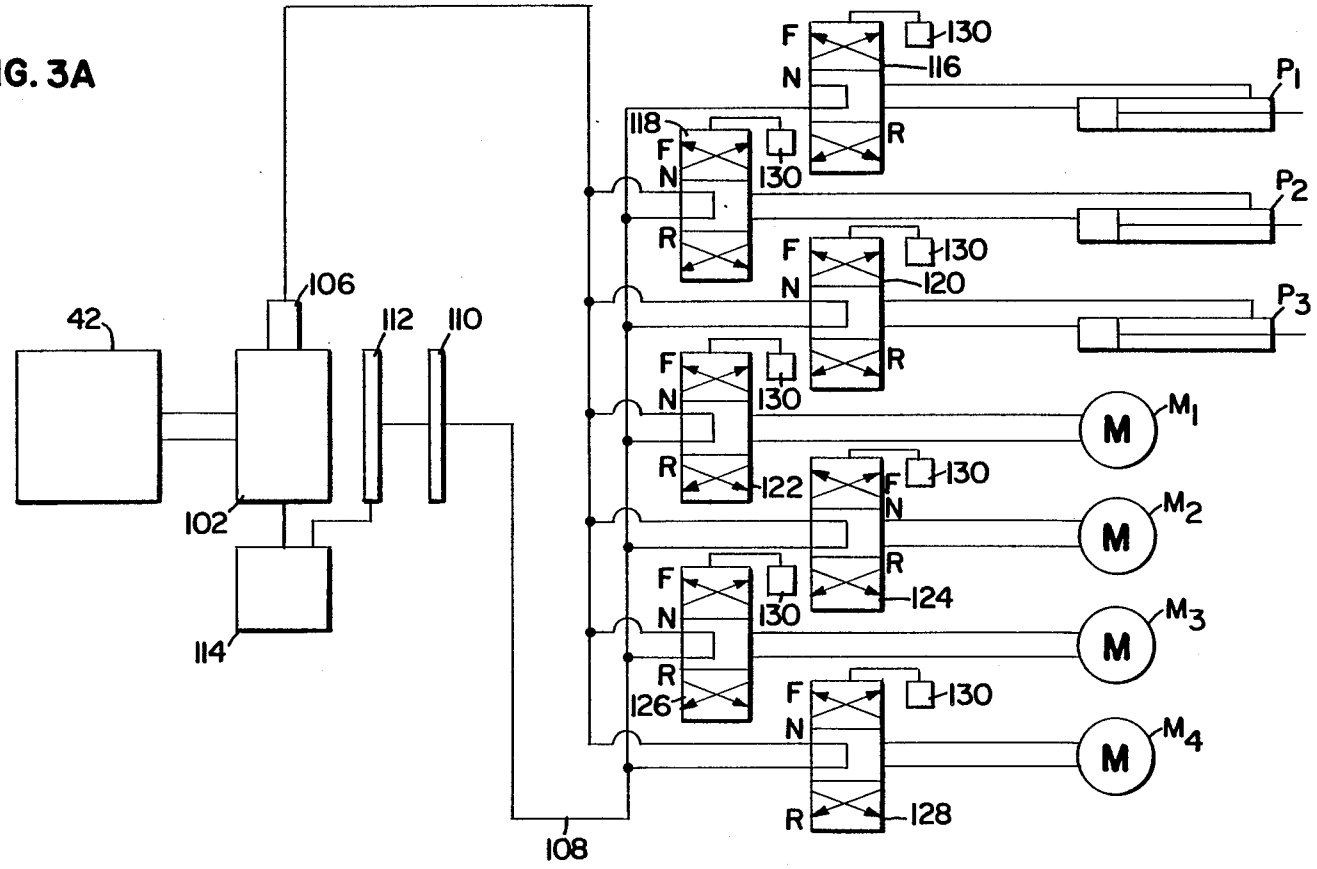

Referring now to FIGS. 3A and 3B, the preferred control system for operating apparatus 10 will now be described. Internal combustion engine 42 has an output shaft connected via a transmission 104 to a hydraulic pump 102. Hydraulic pump 102 is arranged to provide pressurized hydraulic fluid to a supply manifold 106, which supplies various hydraulic circuit within the apparatus 10, as will be described below. A return manifold 108 is provided for returning hydraulic fluid from the various hydraulic circuits, and is connected to a filter 110 which separates various impurities from the hydraulic fluid. Filter 110 is connected to a hydraulic fluid core 112, which is in turn connected to a fluid storage tank 114. Tank 114 further supplies the hydraulic fluid which is provided to hydraulic pump 102. A plurality of double-acting solenoid actuated valves 116–128 are provided for controlling the various piston-cylinder assemblies and hydraulic motors which are used in apparatus 10. A first valve 116 is provided for controlling the piston-cylinder assembly $P_2$, which is arranged to selectively pivot first boom section 52 relative to boom support platform 22. Valve 116 is shiftable between an "F" position which extends $P_1$, a "N" position which maintains $P_1$ in a static condition and "R" position which causes $P_1$ to retract. A second valve 118 is provided for controlling piston-cylinder assembly $P_2$, which controls relative movement between the first and second boom section 52, 60. A third valve 120 is provided for controlling extension of piston-cylinder unit $P_3$, which controls the relative position between second boom section 60 and third boom section 70. As described above in reference to valve 116, valves 118 and 120 are each shiftable between an "F" position which extends the respective piston-cylinder unit, an "N" position which maintains the piston-cylinder in a static position and "R" position which causes the piston-cylinder unit to contract.

A fourth valve 122 is provided for controlling operation of the hydraulic motor $M_1$ which is used to control rotation of turret 20 relative to the support platform 12. Hydraulic motor $M_1$ is mechanically connected to rotate turret 20 through a mechanical drive train which is of an ordinary variety that is well-known in the art, such as by a pair of sprockets and a chain. When valve 122 is in an "F" position, $M_1$ is caused to rotate turret 20 in a clockwise direction. When valve 122 is in an "N" position, turret 20 remains static with respect to support platform 12. When valve 122 is shifted to an "R" position, motor $M_1$ is caused to rotate turret 20 in a counter-clockwise position.

A valve 124 is provided for controlling operation of the hydraulic motor $M_2$, which is used to power winch assembly 80 in a manner which has been previously described. Valve 124 is shiftable between an "F" position in which winch assembly 80 is caused to wind cable 86, an "N" position in which winch assembly 80 remains static, and an "R" position in which winch assembly 80 is caused to unwind the cable 86.

A fifth valve 126 is provided for controlling third hydraulic motor $M_3$, which is mechanically connected to drive the left wheels 14 of support platform 12 through a mechanical transmission of a type which is common and known in the art, such as a drive sprocket and chain arrangement. When valve 126 is in an "F" position, motor $M_3$ is caused to rotate left wheels 14 in a clockwise direction. When valve 126 is in an "N" position, motor $M_3$ is caused to remain static. When valve 126 is shifted to an "F" position, wheels 14 are caused to rotate in a counter-clockwise direction.

A sixth valve 128 is provided for controlling the right side wheels 16 on support platform 12. Valve 128 controls a hydraulic motor $M_4$ which is connected to right wheels 16 through a mechanical transmission identical to that used for driving the left side wheels 14. Valve 128 is shiftable "F", "N" and "R" positions for driving motor $M_4$ in a manner identical to that described above with reference to valve 126 and $M_3$.

Referring now to FIG. 3B, a representative control system 130 which is provided for controlling each of the valves 116–128 will now be described. Each of the valves $V_n$ is biased in a first direction by a resilient spring member 132 and in a second direction by a resilient spring member 134. Each valve $V_n$ is connected to a double acting solenoid 136 by a control shaft 138. Double acting solenoid 136 is provided with a first voltage supply lead 140, a ground potential lead 142 and a second voltage supply lead 144. Solenoid 136 is constructed so that it will move valve $V_n$ to a forward position when a positive voltage is applied to lead 140, and will move valve $V_n$ in a reverse direction when voltage is applied to lead 144.

A DC power supply 146 is grounded at a negative potential end thereof, and is connected to a first moveable contact 152 of a single pole double throw switch 150 via a potentiometer 148 at a positive potential end thereof. Switch 150 further includes a contact 156 which is in communication with lead 140, and a contact 154 which is in communication with lead 144. In operation, valve $V_n$ may be shifted between the forward, neutral and reverse positions by manipulating switch 150. Each of the switches 150 for controlling valves 116–128 are preferably positioned on remote control unit 27 and operate the various valves via cable 29 so that an operator can control operation of the assembly near the structure which is being constructed.

Turning now to FIGS. 4 and 5, a first embodiment of block gripping assembly 96 will now be described. As has been previously described, a horizontally extending inner support bar 158 is secured to the D-ring 92 of winch assembly 80 by a chain 94, which is attached at each end thereof to an end cap 166. As shown in FIG. 4, a plurality of hook members 162 are suspended from inner support bar 158 by means of sleeve member 160 which slides thereover. Sleeve members 160 are spaced from each other by a number of spacer sleeves 164. In the preferred embodiment, three hook members 162 and two spacer sleeves 164 are provided on a single inner support bar 158. The end caps 166 are provided on an outer surface of inner support bar 158 for retaining the respective sleeve members 160 against the adjacent spacer sleeves 164. End caps 166 are retained on inner support bar 158 by the force applied by chain 94. Each of the hook members 162 include a lower tongue portion 172 which is adapted to seat against an inner web of a KeyStone TM type of block 176 or an equivalent modular building component. In order to provide lateral support for the blocks 176, each hook member 162 is further provided with a stopped tab 174 at a forward end portion of tongue 172, and an upwardly extending back portion 170 which is secured to the rear of tongue 172. A connecting piece 168 secures back portion 170 to sleeve member 160, as is shown in FIG. 5. In the preferred embodiment, hook members 162 are spaced approximately 18 inches apart to ensure compatability with the KeyStone TM design.

In operation, a gripping assembly constructed according to the embodiment of FIG. 4 and 5 is lowered by the apparatus 10 into a position for receiving a trio of modular blocks. Once the modular blocks have been secured to the hook members 162, they are moved via apparatus 10 to their desired position on the structure which is being constructed. Due to the unique structure of the hook members 162, each of the blocks may be laid horizontally onto the structure by setting the blocks endwise onto the structure and continuing to move the hook members forwardly toward the open end of the hook members. Once the modular blocks have been positioned, the gripping assembly is removed.

Figure 6:
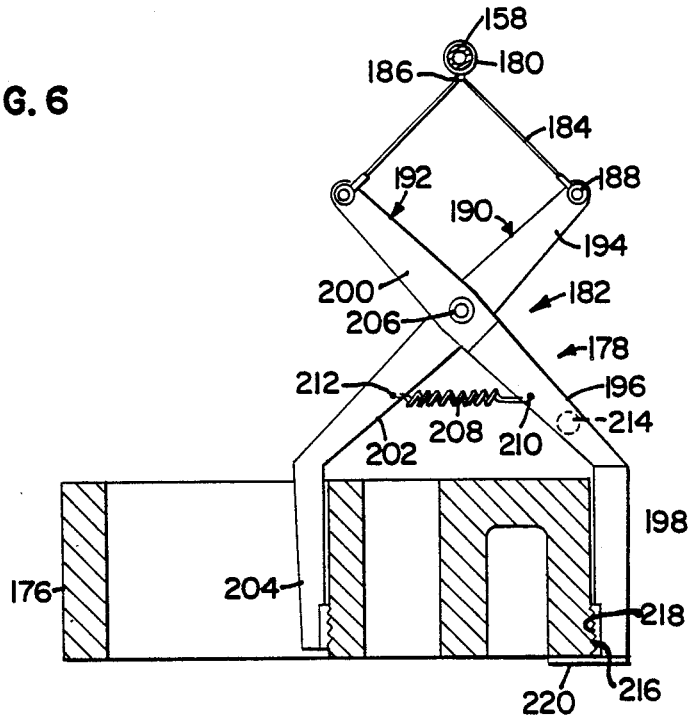
FIG. 6 is a side elevational view of a gripper constructed according to a second embodiment of the invention.
Figure 7:
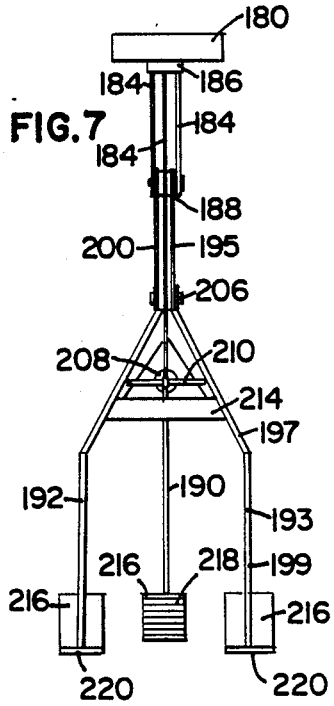
FIG. 7 is an end view of the gripper illustrated in FIG. 6.

Referring now to FIGS. 6 and 7, a second embodiment 178 of the gripper assembly is suspended from a sleeve member 180, which is adapted to be received on inner support bar 158 in a manner identical to that described above in reference to the previous embodiment. Three cables 184 are suspended by a cable support 186 which is attached to a lower portion of sleeve member 180, as is shown in FIG. 6. The three cables 184 are connected through bolt-eyelet connections 188 to upper sections of respective arms forming a scissor-type linkage 182, the structure of which will be described below.

First arm member 190 is provided with an upper section 194 to which a cable 184 is joined through a bolt-eyelet connection 188, a lower section 196 and a gripper section 198 which is joined to a lower end of the lower section 196. Second arm member 192 includes an upper section 200 which is joined to a cable 184 through a bolt-eyelet connection 188, a lower section 196 and a gripper section 198 which is positioned to oppose the gripper section 204 of first arm member 190. Third arm member 193 is provided with an upper section 195 connected to a cable 184 via a bolt-eyelet connection 188, a lower section 197 and a gripper section 199 connected to a lower end of section 197. Gripper section 199 is mounted in alignment with gripper section 204 of the second arm member 192 in order to oppose the gripper section 198 of first arm 190.

A tension spring 208 is connected between a spring retaining pin 210 which extends between the lower sections 196, 197 of the second and third arm members 192, 193 respectively, and a hole 212 which is defined in lower section 202 of the first arm member 190. Tension spring 208 tends to bias the various gripper sections toward their closed position when the gripper assembly is not in use.

Gripper assembly 178 is further provided with a handle support member 214 which extends between the lower section 196 of the second arm member 192 and the lower section 197 of third arm member 193. Handle support 214 provides structural rigidity between the second and third arm members 192, 193 and may be used by an operator to manually stabilize the gripping assembly 178 during loading, transport and unloading of a trio of modular blocks.

Each of the gripper sections 198 is preferably provided with a gripper plate insert 216 having a plurality of gripper teeth 218 defined on a gripping edge thereof. An inwardly extending nose plate 220 may further be provided on the gripper sections 198, 199 of the second and third arm members 192, 193 to further secure a trio of modular building components to the gripper assembly 178 during use.

It is to be understood that three of the gripper assemblies 178 are to be connected across a horizontal inner support bar 158 with spacer sleeves 164 therebetween in the manner described above in regard to the embodiment of FIGS. 4 and 5.

Figure 8:
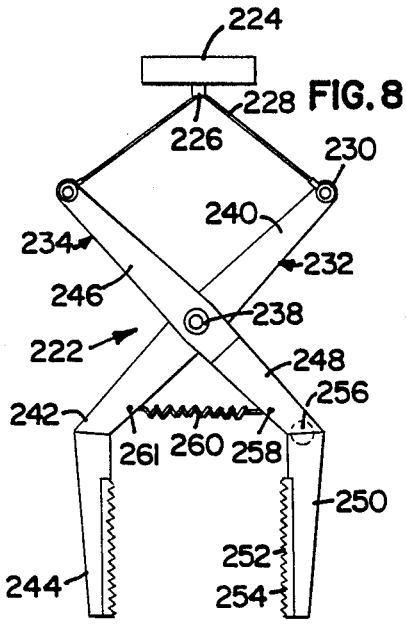
FIG. 8 is a side elevational view of a gripper constructed according to a third embodiment of the invention.
Figure 9:
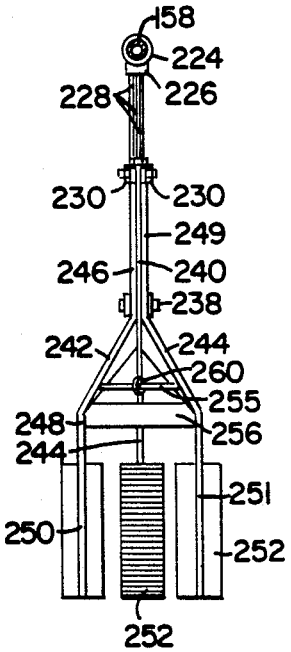
FIG. 9 is an end view of the gripper illustrated in FIG. 8.

Referring now to FIGS. 8 and 9, a third embodiment 222 of the gripper assembly will now be described. Gripper assembly 222 includes a third sleeve member 224 which is suspended from inner support bar 158 in the manner described above in regard to previous embodiments. Sleeve member 224 includes a cable retainer 226 for retaining a trio of suspension cables 228 which support upper arms of a scissor-type linkage, as will be described further below.

Gripper 222 includes a first arm member 232, a second arm member 234 and a third arm member 236. A pivot joint 238 permits first arm member 232 to be pivoted with respect to the unit consisting of the second and third arm members 234, 236. First arm member 232 includes an upper section 240, a lower section 242 and a gripper section 244. Likewise, second arm member 234 includes an upper section 246, a lower section 248 and a gripper section 250. Third arm member 236 includes an upper section 247, a lower section 249 and a gripper section 251. The upper sections 240, 246 and 247 of the three arm members are connected to corresponding cables 228 via bolt-eyelet type connections 230 as is shown in FIG. 8. A tension spring 260 is provided between a hole 261 defined in the lower portion 242 of first arm member 232 and a spring retaining pin 258 which is secured between the lower sections 248, 249 of the second and third arm members 234, 236. Each of the gripper sections 244, 250 and 251 are provided with a gripper plate insert 252 having a plurality of gripper teeth 254 formed thereon. Gripper plates 252 extend approximately 6 inches along an inside length of each of the gripper sections 244, 250, 251. Gripper plates 252 are approximately 2 inches in width, and the gripper section 250 of second arm member 234 and the gripper section 251 of third arm member 236 are approximately 5¼ inches apart. A handle support member 256 is further provided between lower portions 248, 249 of the second and third arm members 234, 236 for providing stability between the two arm members 234, 236 and for aiding manual handling of the assembly during use.

Figure 11:
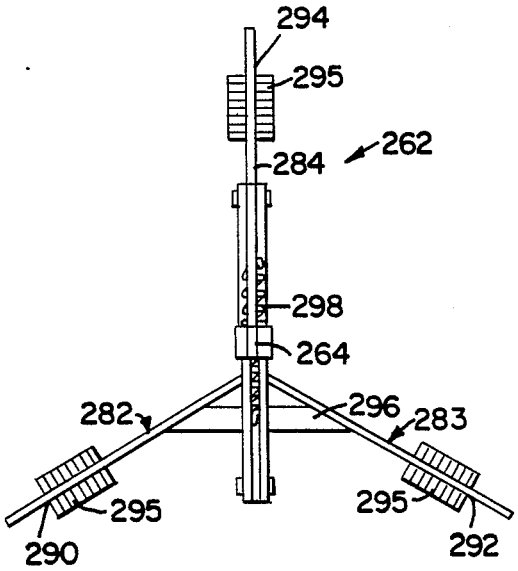
FIG. 11 is a top plan view of the gripper illustrated in FIG. 10.
Figure 10:
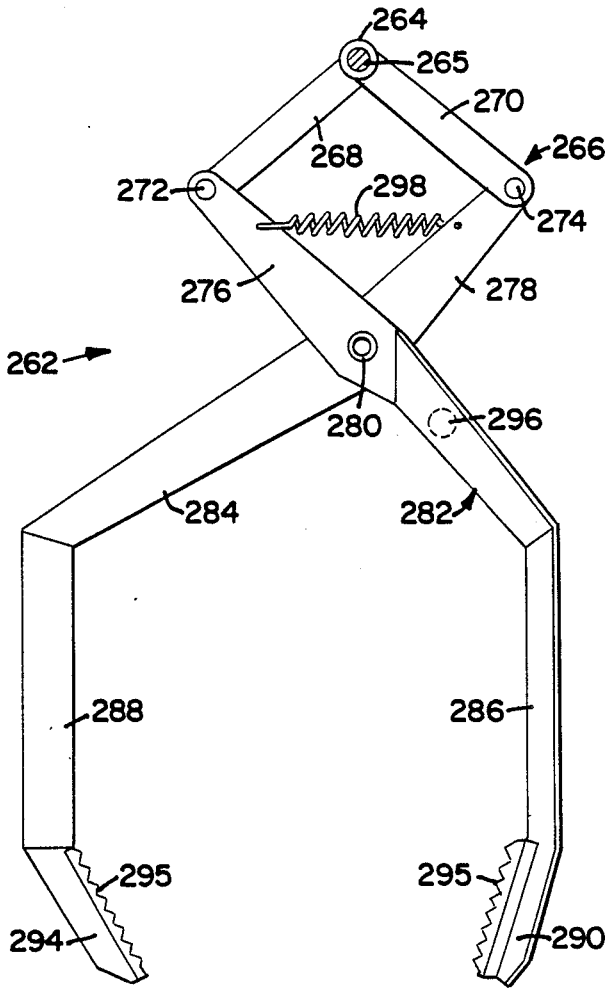
FIG. 10 is a side elevational view of a gripper constructed according to a fourth embodiment of the invention.

A fourth embodiment 262 of the gripper assembly is illustrated in FIGS. 10 and 11. This embodiment has particular utility for handling large building components such as boulders. Gripper 262 includes a sleeve member 264 which is supported by a support pipe 265. Support pipe 265 is in turn supported from the swivel joint 90 by the D-ring 92 in the manner illustrated in FIG. 1. In this embodiment, only one gripper assembly 262 is designed to be suspended beneath support pipe 265. The gripper assembly 262 includes a first arm 268 and a second arm 270 which are pivotally suspended from support pipe 265 by attachment to separate split portions of the sleeve member 264. A first gripper arm 276 is pivoted to first arm 268 by a pivot joint 272. Likewise, a second gripper arm 278 is pivoted with respect to second arm 270 by a pivot joint 274. Beneath pivot joint 280, first gripper arm 276 bifurcates into a first gripper portion 282 and a second gripper portion 283, as is shown in FIG. 11. The first gripper portion 282 is provided with an inwardly extending gripper foot 290 having a gripper plate 295 mounted thereon, as is shown in FIG. 10. Likewise, the second gripper portion 283 is provided with an inwardly extending gripper foot 292 having a gripper plate 295 mounted thereon. Each of the gripper plates 295 are provided with a plurality of gripping teeth on an inner surface thereof for engaging a boulder or similar piece during operation. As shown in FIG. 10, second gripper arm 278 is provided with a lower portion 284 having a back piece 288 and a gripper foot 294 mounted to a lower end thereof. Gripper foot 294 is provided with a gripper plate 295 having teeth defined therein. As is visible in FIG. 11, gripper foot 294 is mounted in opposition with gripper feet 290, 292, so as to provide for a firm grip on a work piece such as a boulder. A tension spring 298 is provided between upper portions of the first gripper arm 276 and the second gripper arm 278 so as to bias the gripper 262 to a closed position prior to engagement with work piece. A handle support 296 is provided between the first and second gripper portions 282, 283 of the first gripper assembly in order to provide rigidity to the first gripper arm and provide a gripping surface for stabilizing, orienting and guiding the gripper assembly during operation.

Figure 12:
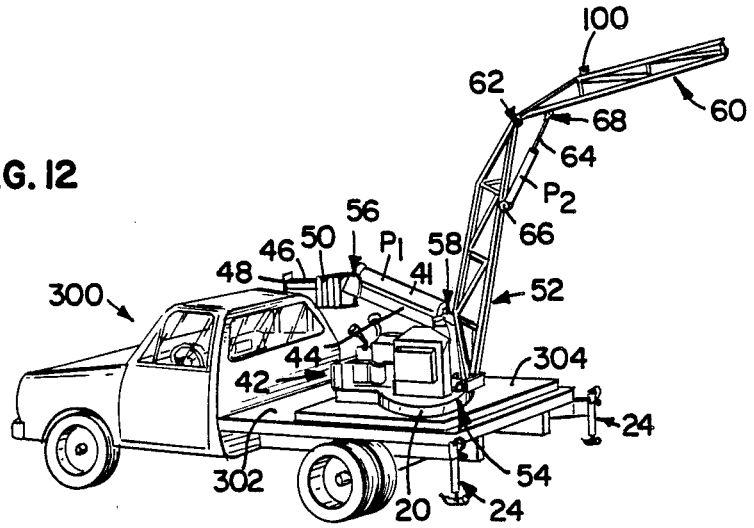
FIG. 12 is a perspective view of a modified embodiment of the apparatus illustrated in FIG. 1.

Referring now to FIG. 12, a second alternative embodiment of the invention shown in FIG. 1 includes a support platform 304 which is mounted in a bed 302 of a truck 300. In this embodiment, it is not necessary to load and unload the apparatus from a trailer or like hauling device prior to or after operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for handling building components of the type which are used in retaining walls, comprising:

(a) vehicular support means for positioning the apparatus at a desired location;

(b) turret means mounted for rotation with respect to said vehicular support means;

(c) adjustable boom means having a first end mounted to said turret means and a second end;

(d) means adapted for gripping at least one building component;

(e) means mounted to said boom means proximate said second end for suspending said gripping means, further comprising:

(i) a rotating drum;

(ii) a cable, the cable having a free end, the cable being would onto the rotating drum, the rotating drum thereby permitting the cable to be adjustably extended from the boom means;

(iii) a swivel joint, the swivel joint being cooperatively affixed to the free end of the cable;

(iv) an annular chain support, the annular chain support being affixed to the swivel joint;

(v) a chain, the chain being threaded through the annular chain support;

(vi) a pair of end caps, one of each of the end caps being affixed to an end of the chain;

(vii) an inner support bar, the inner support bar having a first end and a second end, one of the pair of end caps being mated to the first end of the inner support bar and a remaining end cap being mated to the second end of the inner support bar; and (viii) a sleeve member, the sleeve member being rigidly attached to the means adapted for gripping at least one building component, the sleeve member being adapted to be slidably mounted on the inner support bar, the sleeve member being retained on the inner support bar by the pair of end caps; and (f) means for controlling at least said turret means and said boom means;

wherein said turret means includes means for pivotally mounting said first end of said boom means to said turret means, and means for pivoting said boom means about said pivotal mounting means;

wherein said turret means further comprises:

(a) adjustable means for counter balancing force applied to said turret means by said boom means;

(b) a boom support platform, the boom support platform being cooperatively affixed to the turret means;

(c) a support bracket, the support bracket being cooperatively affixed to the boom support platform;

(d) a counterweight holder, the counterweight holder being rigidly affixed to the support bracket;

(e) a retaining lip, the retaining lip being affixed to the counterweight holder, and (f) at least one counterweight member, the counterweight member being manually mountable onto the counterweight holder, the counterweight member being retained on the counterweight holder by the retaining lip;

wherein the means for pivoting the boom comprises a length extensible cylinder having a first end pivotally mounted to the boom proximate the first end of the boom, and a second end pivotally mounted to the support bracket, whereby a building component may be gripped and transported to a desired position.

2. Apparatus according to claim 1, wherein said vehicular support means comprises at least one left side means for propelling said support means and at least one right side means for propelling said support means, whereby said support means may be positioned with respect to an underlying surface.

3. Apparatus according to claim 2, wherein said controlling means further controls said left side means and said right side means.

4. Apparatus according to claim 1, wherein said vehicular support means further includes at least one extendable stabilizer means for stabilizing the apparatus with respect to an underlying surface.

5. Apparatus according to claim 1, wherein said adjustable boom means comprises a first boom section pivotally mounted to said turret means, a second boom section pivotally mounted to said first boom section, and means for pivoting said second boom section with respect to said first boom section.

6. Apparatus according to claim 5, wherein said adjustable boom means further comprises a third boom section pivotally mounted to said second boom section and means for pivoting said third boom section with respect to said second boom section.

7. Apparatus according to claim 1, wherein said controlling means further controls said suspending means.

8. Apparatus according to claim 1, wherein said controlling means includes remote control means for controlling at least said turret means and said boom means from a position that is remote from said vehicular support means.

9. Apparatus according to claim 1, wherein said gripping means is adapted for gripping a plurality of building components.

10. Apparatus according to claim 9, wherein said gripping means comprises a plurality of gripping units, and a common means for supporting said plurality of gripping units.

11. Apparatus according to claim 8, wherein said gripping means comprises:

a support means;

a first arm pivotally mounted to said support means at a first end and having a second end;

a second arm pivotally mounted to said support means at a first end and having a second end;

a first gripper arm having a first end pivotally connected to said second end of said first arm;

a second gripper arm having a first end pivotally connected to said second end of said second arm;

a first gripper portion connected to a second end of said first gripper arm;

a second gripper portion connected to a second end of said second gripper arm; and means for pivoting said first gripper arm with respect to said second gripper arm, whereby the gripper arms are caused to tighten on a component as it is lifted.

12. Apparatus according to claim 11, further comprising a third gripper portion connected to said second end of said second gripper arm.

13. Apparatus according to claim 12, wherein each of said first, second and third gripper portions include an inwardly extending gripper foot.

14. Apparatus according to claim 13, wherein each of said gripper feet include at least one gripper plate having a number of gripper teeth thereon.

15. Apparatus according to claim 11, further comprising means for biasing said first gripper portion apart from said second gripper portion.

* * * * *

UNITED STATES PATENT AND TRADEMARK OFFICE

CERTIFICATE OF CORRECTION

PATENT NO. : 4,969,789

DATED : November 13, 1990

INVENTOR(S) : Gregory P. Searle

It is certified that error appears in the above-identified patent and that said Letters Patent is hereby corrected as shown below:

In column 1, line 18, please delete "nodules" and substitute therefore --modules--.

In column 4, line 45, please delete "$P_2$" and substitute therefore --$P_1$--.

In column 8, line 37, please insert --the-- after the word "with".

In column 9, line 8, please the delete the word "would" and substitute therefore --wound--.

Signed and Sealed this

Fifth Day of May, 1992

*Attest:*

DOUGLAS B. COMER

*Attesting Officer*

*Acting Commissioner of Patents and Trademarks*